US007441695B1

(12) United States Patent
Saltsov et al.

(10) Patent No.: US 7,441,695 B1
(45) Date of Patent: Oct. 28, 2008

(54) VALIDATOR WITH IMPROVED RECYCLING CASSETTE

(75) Inventors: Leon Saltsov, Thornhill (CA); Dmitro Baydin, Etobicoke (CA); Yuriy Rusakov, Aurora (CA); Sergiy Androsyuk, Etobicoke (CA); Oleksandr Lukonin, Etobicoke (CA)

(73) Assignee: Crane Canada Co., Concord, ON (CA)

( * ) Notice: Subject to any disclaimer, the term of this patent is extended or adjusted under 35 U.S.C. 154(b) by 0 days.

(21) Appl. No.: 11/808,431

(22) Filed: Jun. 11, 2007

(30) Foreign Application Priority Data

Apr. 27, 2007 (CA) ..... 2,586,469

(51) Int. Cl.
*A45C 1/12* (2006.01)

(52) U.S. Cl. ..... 232/1 D; 235/379; 194/206; 209/534; 271/3.01

(58) Field of Classification Search ..... 232/1 D, 232/15–16, 7, 12; 235/379; 194/206–207; 209/534; 271/3.01
See application file for complete search history.

(56) References Cited

U.S. PATENT DOCUMENTS

| | | | | |
|---|---|---|---|---|
| 6,371,473 | B1 * | 4/2002 | Saltsov et al. | 271/3.01 |
| 6,619,461 | B2 * | 9/2003 | Saltsov et al. | 194/317 |
| 7,051,926 | B2 * | 5/2006 | Saltsov et al. | 235/379 |
| 7,278,527 | B2 * | 10/2007 | Daout et al. | 194/206 |
| 2003/0062667 | A1 * | 4/2003 | Saltsov et al. | 271/3.14 |
| 2006/0214350 | A1 * | 9/2006 | Saltsov et al. | 271/3.01 |
| 2006/0219516 | A1 * | 10/2006 | Saltsov et al. | 194/207 |

* cited by examiner

*Primary Examiner*—William L. Miller

(57) ABSTRACT

A banknote acceptor and dispenser uses a stacked configuration of the validator the banknote accumulator and dispenser and the banknote cassette. The banknote accumulator includes a count window providing information of the banknotes stored in the accumulator. Preferably the count window has an electronic display of the number of banknotes accumulated.

14 Claims, 6 Drawing Sheets

VALIDATOR WITH IMPROVED RECYCLING CASSETTE

FIELD OF THE INVENTION

The present invention relates to banknote acceptors and dispensers, and improvements in the operation thereof.

BACKGROUND OF THE INVENTION

Automated banknote acceptors and recyclers are now being used in many applications. Early banknote acceptors included a depleting supply of banknotes to provide change. These systems required frequent service to provide a new supply of banknotes and it was difficult to anticipate when service would be required. In a banknote recycling system, the arrangement includes a banknote accumulator where banknotes provided for payment by the customer are selectively stored in an accumulator for later dispensing as change. These types of arrangements reduce the frequency of service required to replenish banknotes and/or increase the transaction capabilities of the system.

It is a common practice in the vending industry to include a coin dispensing arrangement. It is also known with respect to vending machines to provide an arrangement where coins inserted by a customer are accumulated by the device for dispensing as change for a subsequent transaction.

Vending machines are now used for the sale of more expensive product and banknote validators are now commonly used in vending machines. The acceptance of banknotes, including banknotes of higher denominations, has increased the demand to recycle banknotes, making the banknotes available for settlement of future transactions. This capability increases the time between service of the device and reduces the probability of a lost sale due to the inability to provide the correct change.

The present invention provides further improvements of the banknote accumulator and the control thereof by an operator.

SUMMARY OF THE INVENTION

A banknote acceptor and dispenser according to the present invention comprising a banknote validator, a banknote accumulator and dispenser for temporarily receiving banknotes for dispensing as change for subsequent transactions and a removable banknote cassette.

The banknote accumulator and dispenser includes a count window that provides banknote information of the banknotes stored in the banknote accumulator and dispenser.

In an aspect of the invention, the banknote accumulator and dispenser, includes at least two actuators that allow an operator to load or unload the accumulator and dispenser with banknotes in an automated manner.

In a further aspect of the invention, the banknote acceptor and dispenser has a reversible banknote drive path that extends between said banknote validator and said banknote accumulator and dispenser.

In a further aspect of the invention, the banknote acceptor and dispenser includes a manual crank for manual adjustment of said banknote accumulator and dispenser.

In a preferred aspect of the invention, the banknote accumulator and dispenser has a back face with a series of actuators for loading and unloading of banknotes in said banknote accumulator and dispenser.

In an aspect of the invention, the said banknote accumulator and dispenser includes an electrical set arrangement for setting of a banknote denomination to be accumulated and dispensed.

In a preferred aspect of the invention, the electrical set arrangement includes at least two dip switches where each dip switch has at least two positions, preferably the electrical set arrangement is provided on an exterior rear surface of said accumulator and dispenser.

In yet a further aspect of the invention, the count window includes an electronic display, visible through said count window.

In a preferred aspect of the invention, the electronic display displays the number of banknotes accumulated in the banknote accumulator and dispenser.

In a different aspect of the invention, the banknote acceptor and dispenser includes a removable cover movable between a position covering said manual crank to an open position allowing access to said manual crank.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
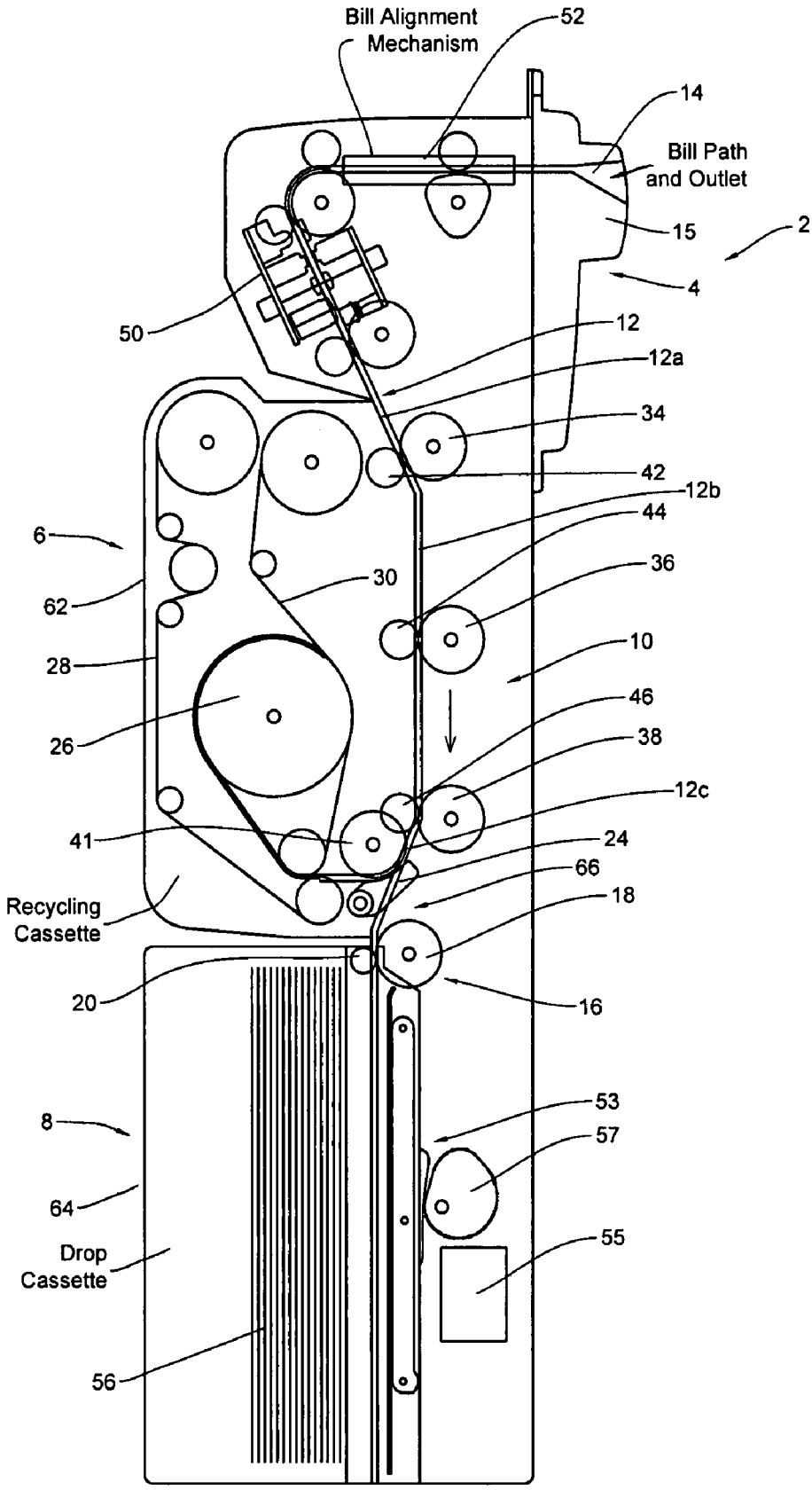
FIG. 1 is a vertical sectional view showing the banknote acceptor and dispenser.

The banknote acceptor and dispenser 2 includes the banknote validator 4, an intermediary banknote accumulator and dispenser 6, and a removable banknote cassette 8. These components are preferably releasably held in the structural frame 10 with many of the operating components drive motors, drive gears, etc., mounted on the frame. The banknote validator 4, the banknote accumulator and dispenser 6 and the removable banknote cassette 8 are in an aligned stacked arrangement to reduce the depth of the banknote acceptor and dispenser. The banknote accumulator and dispenser 6, as well as the removable banknote cassette 8 are releasably held in the structural frame 10 to allow manual removal without requiring tools.

The banknote acceptor and dispenser 2 includes the reversible banknote path 12 which connects the banknote inlet/outlet 14 associated with the bezel 15 and directs a banknote to the banknote accumulator and dispenser 6 or the banknote cassette 8 as determined by the device if the banknote is accepted. Basically, the banknote validator accepts or rejects banknotes based on an evaluation carried out in the validator using the sensors 50. If the banknote is accepted, it will be moved along the banknote path 12 and directed by banknote gate 24 to the banknote accumulator and dispenser 6, if the gate is in the position of FIG. 1, or the banknote will be directed to the banknote cassette 8 if the gate is in the position shown in FIG. 2. The roller drive arrangement operates in a consistent manner and it is the banknote gate 24 that determines the final destination of a received banknote.

The banknote validator includes a processor and computing arrangement for determining whether a banknote will be accumulated for later dispensing or merely stored in the banknote cassette. Typically, the software is based on a single denomination of banknote being accumulated by a banknote accumulator and dispenser.

As will be subsequently described with respect to FIGS. 5 and 6, the banknote accumulator and dispenser can be set for different denominations.

If a received banknote is of sufficient quality and of the correct denomination, it will typically be accumulated by the accumulator and dispenser 6 unless this device is at a maximum capacity. Typically, the capacity of the banknote accumulator is at least 20 banknotes and it is preferably 30 banknotes or more.

The limitation on the number of banknotes to be stored is basically a space requirement and it is desired that the back face 62 of the accumulator is approximately in line with or slightly inwardly of the back face 64 of the banknote cassette 8. To allow for additional banknotes to be accumulated in device 6, the banknote path 12 includes an angled transition 12*a* which connects to the inwardly offset portion 12*b* associated with the accumulator 6 and a further angled transition portion 12*c* for connecting with the inlet 66 of the banknote cassette 8. The angled transition 12*c* provides a banknote to the drive roller 18 and idler roller 20 at the first portion of the removable banknote cassette 8. The offsetting of the banknote path at 12*b* allows for additional room within a central portion of the banknote accumulator and dispenser 6. In this way, additional banknotes can be stored on the banknote accumulating drum 26. The angled transition portion 12*c* connects to the normal slightly offset inlet of a banknote cassette. A banknote pusher arrangement 53 is provided to one side of the banknote cassette. A drive motor 55 is provided in the frame 10 for driving the pusher arrangement 53 via the cam actuator 57, also secured in the frame 10.

When a banknote is fed to the banknote accumulator and dispenser via the gate 24, the banknote is wound around the drum 26 and includes opposed separating tapes 28 and 30 either side of the banknote. In this way, banknotes are wound on the drum 26 in a sequential manner and are unwound from the drum in a sequential manner and returned to the banknote path 12.

The banknote path 12 moves a received banknote through the banknote centering mechanism 52 provided in the banknote validator 4. It subsequently moves the banknote past the sensors 50. The validator then determines whether the banknote is valid and whether the valid banknote should be accumulated for later dispensing or merely provided to the banknote cassette 8. The validator controls the position of the banknote gate 24. The validator also controls the drive mechanism for the banknote accumulator and dispenser 6. It will only operate this mechanism when a banknote is to be received or when a received banknote in the accumulator is to be dispensed and provided to the banknote path 12 and moved to the banknote inlet/outlet 14.

From FIG. 1 it can also be seen that the banknote path 12 basically terminates at the upper end of the banknote cassette 8. This provides a relatively short banknote path and a banknote provided to the first portion 16 of the cassette will continue down in a slot provided in the cassette for stacking in the cassette as indicated by the stack of banknotes 56.

Figure 2:
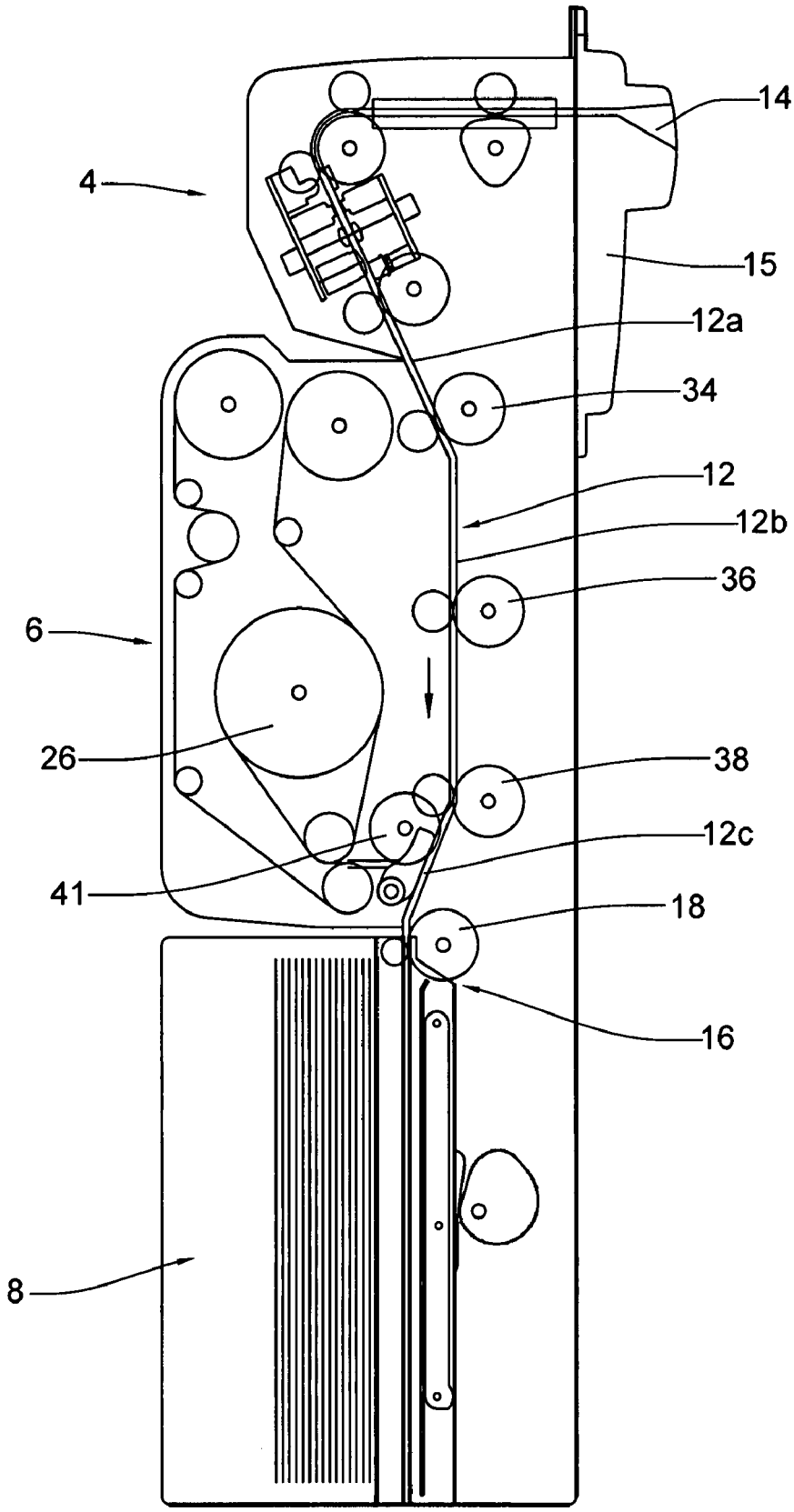
FIG. 2 is a vertical sectional view showing the banknote drive path in a position such that the banknote received by the validator will be provided to the banknote cassette.

FIG. 2 shows the banknote path connecting the inlet/outlet 14 with the banknote cassette.

Figure 3:
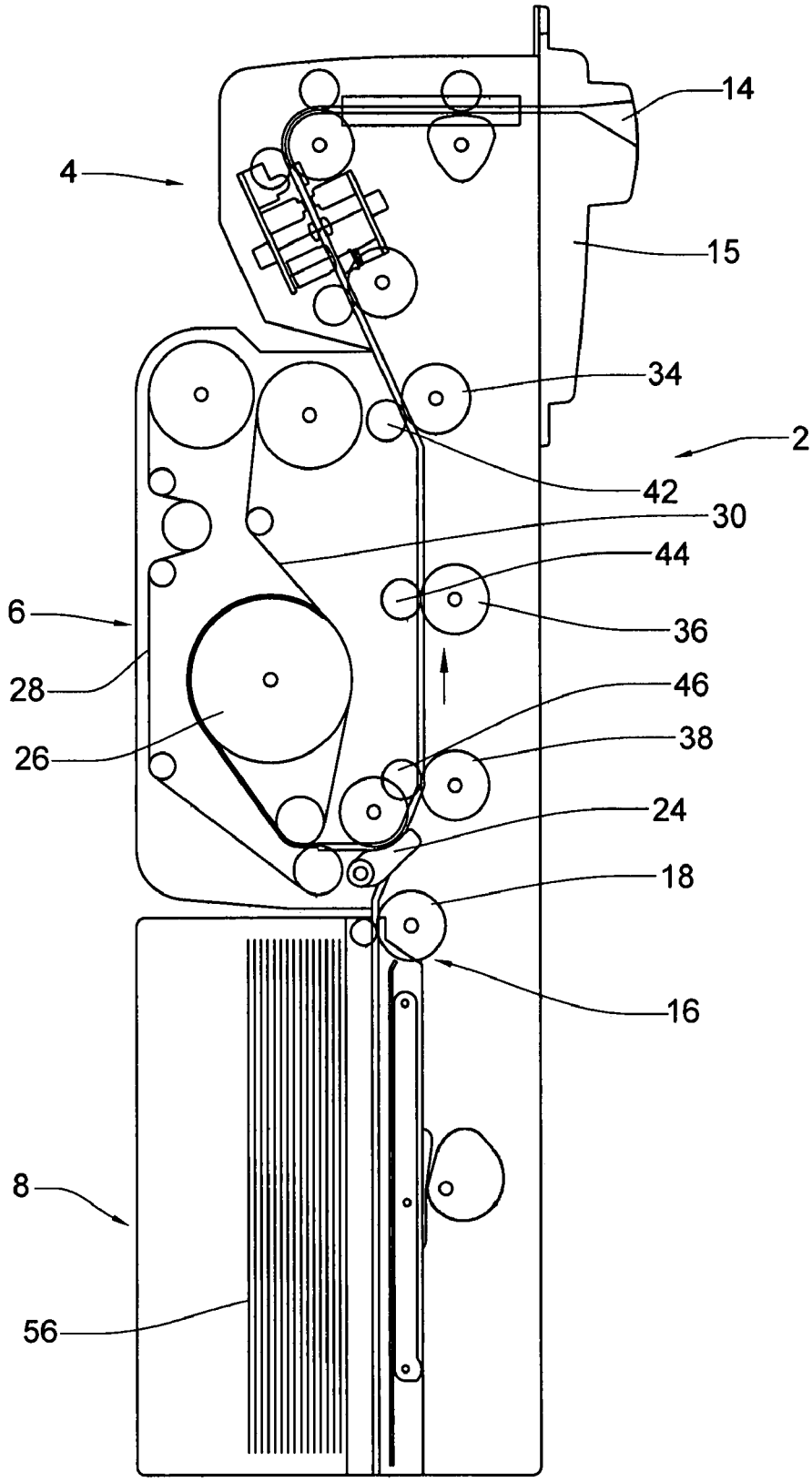
FIG. 3 is a vertical sectional view similar to FIGS. 1 and 2 with the banknote accumulator actuated to direct a banknote to the accumulator.

FIG. 3 shows the gate 24 in an operative position which allows a banknote stored within the accumulator 6 to be provided to the banknote path and provided as change at the inlet/outlet 14.

Figure 4:
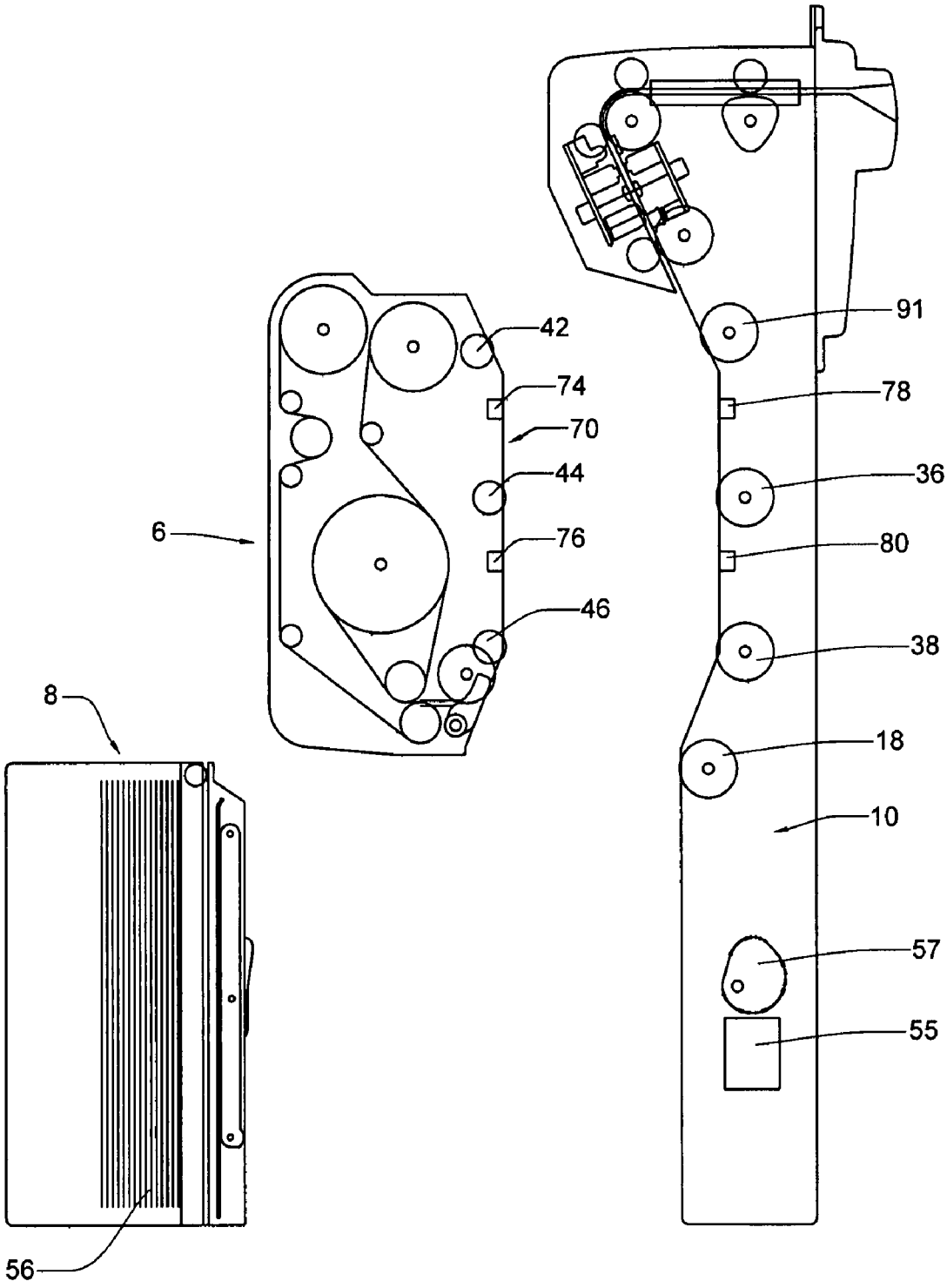
FIG. 4 is a vertical sectional view showing the banknote accumulator and dispenser in a release position and the removable banknote cassette in a release position.

In FIG. 4 the removable banknote cassette 8 has been separated from the structural frame 10 and also the banknote accumulator and dispenser 8 is also separated. As can be seen, the banknote path 12 is now open due to the removal of the banknote accumulator and dispenser 6. Part of the banknote path is defined along the exterior surface 70 of the banknote accumulator and dispenser 6. The active drive rollers 34, 36 and 38 are secured in the structural frame 10 as well as the drive roller 18 and these rollers are connected by a common drive arrangement. Drive rollers 34 and 38 are provided at a transition point associated with the angled transitions 12*a* and 12*c*. The exterior surface 70 of the accumulator 6 also includes projecting idler rolls 42, 44 and 46 which cooperate with the particular drive rollers.

Imbedded in the exterior surface 70 and exposed on the exterior thereof, are light prisms 74 and 76 a beam of light is emitted at the sensors 78 and 80 and the prisms 74 and 76 return the light to these sensors if a banknote is not present. Software logic is provided to determine whether a banknote has become jammed at a certain point in the banknote path or is passing a specific sensor.

FIGS. 1 and 2 also illustrate the cooperation between the banknote gate 24 drive roller 38 and drive roller 41 of the accumulator. Drive roller 41 partially protrudes into the banknote path 12 and assists in moving a banknote to the cassette or to the accumulator. A gear train drives the rollers with power provided by motor secured in the frame 10. With this arrangement roller 41 is driven at the correct speed and the same speed as roller 38.

Figure 5:
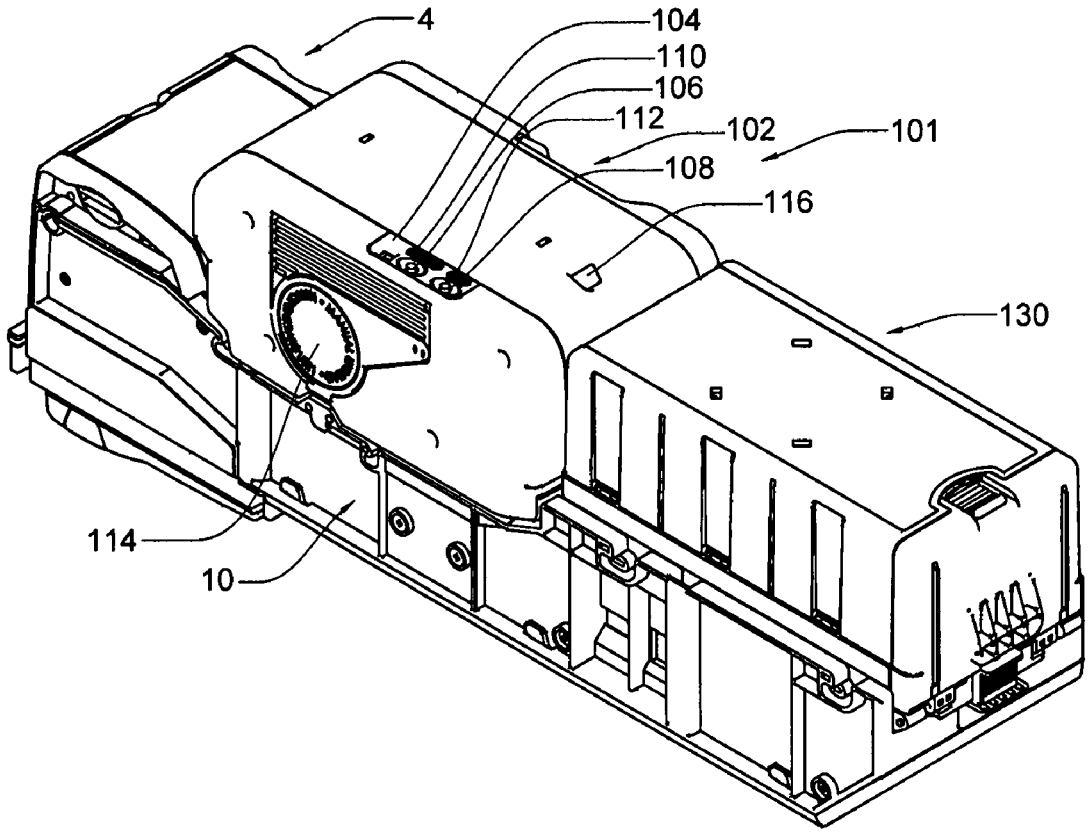
FIG. 5 is a rear perspective view of a modified banknote accumulator and dispenser.
Figure 6:
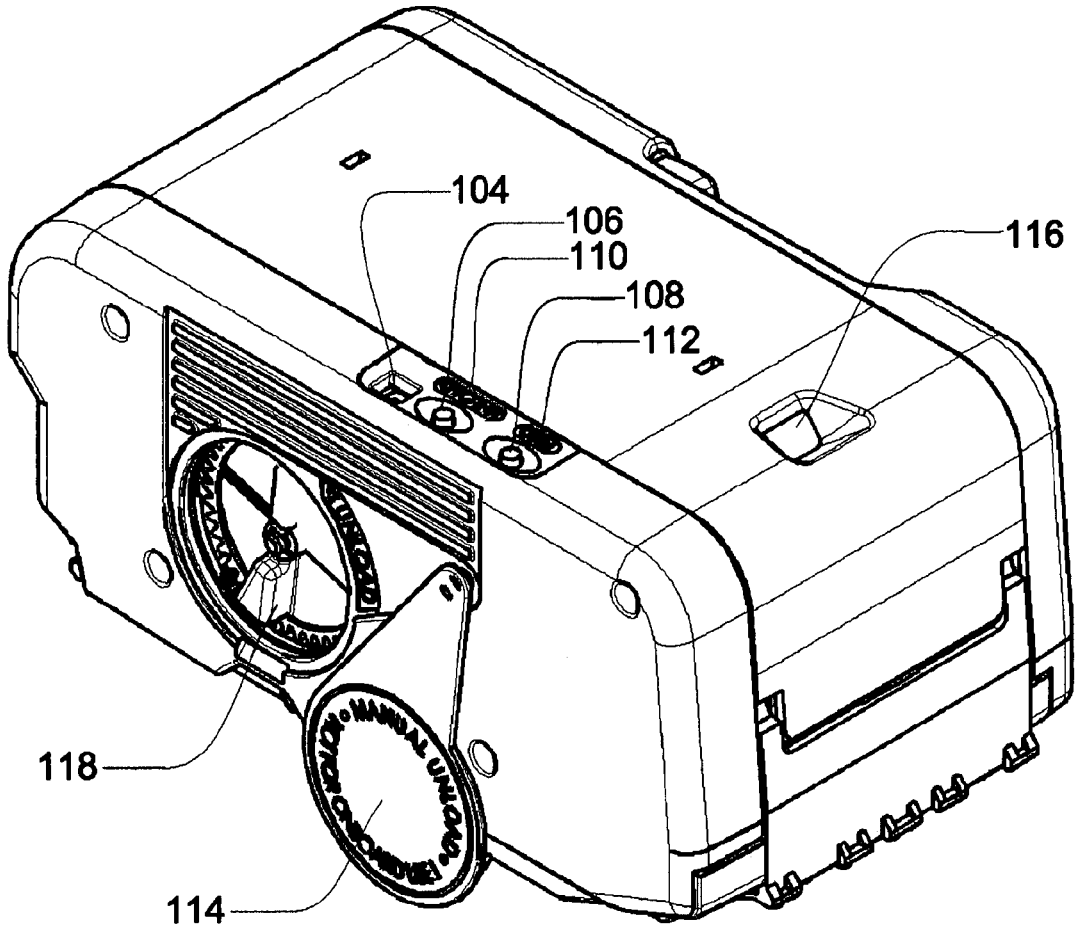
FIG. 6 is a rear perspective view of a modified banknote accumulator.

A modified accumulator 102 is shown in FIGS. 5 and 6 that allows additional operator control when the accumulator is received in the frame 10 of a validator structure. In particular, the modified accumulator 102 provides the operator with a mechanism for control of loading and unloading of banknotes to or from the accumulator.

The modified accumulator 102 includes a load actuator 106 and an unload actuator 108. Each of these actuators when operated, provides a signal to the banknote acceptor and dispenser for completing a particular action. For example, if the banknote acceptor and dispenser 102 are received in a vending machine, the operator may access the vending machine and the back face of the modified accumulator 102 is accessible. By pressing the actuator 106, the operator can feed a number of banknotes through the validator 4 into the banknote accumulator for loading of the banknotes to the modified accumulator. Typically, the banknotes are red through the front bezel of the validator. This provides a simple mechanism for the operator to load the modified accumulator with banknotes of a particular denomination for later use in completing transactions.

The actuator 108 allows for unloading of the modified accumulator 102. For example, the operator may wish to replace the modified accumulator 102 with a different accumulator or merely wish to unload the accumulator. By actuating the unload actuator 108, the banknote acceptor and dispenser 101 causes the modified accumulator 102 to discharge the accumulated banknotes typically into the unlocked plastic cassette 130. This provides a simple arrangement for the operator to carry out this function in an automated manner.

The modified accumulator 102 also includes a two position dip switch 110 and a two position dip switch 112. By changing the position of the dip switches, the operator can program the modified accumulator for storing of banknotes of different denominations. This arrangement allows for the operator to program four predetermined denominations, which in most cases is satisfactory. Additional dip switches could be provided for programming of a further selection of banknotes. This provides a relatively convenient approach for the operator to effectively program the modified accumulator 102.

A further feature of the modified accumulator 102 is the count window 116. This count window displays the number of banknotes that are stored in the accumulator. This provides a simple read out for the operators to determine whether banknotes need to be loaded to the accumulator, or how many banknotes the accumulator has stored. It also provides the number of banknotes that would be discharged to the unlocked plastic cassette if this particular unloading operation was initiated.

Furthermore, it can be appreciated that if there is a problem with the banknote accumulator, for example, if it has become jammed or requires service, the count window 116 provides the number of banknotes that are stored in the accumulator. The modified accumulator 102 can then be removed from the frame 10 of the overall system.

The modified accumulator 102 as shown in FIG. 6 has the removable cover 114 displaced to one side to expose the hand crank 118. Operation of the hand crank allows the operator to unload the accumulator manually. It also allows the user to operate the action of the winding drum and the take up reels and tapes, to ensure the device is operating satisfactorily. This hand crank is typically used with the modified accumulator released from the frame.

A further actuator 104 is shown in FIGS. 5 and 6. At present, this actuator remains unprogrammed, however, it could be used in association with a further function of the accumulator. For example, it could be used to reprogram the dip switches or to extend the programming of the dip switches. Basically, the actuators 104, 106, and 108 communicate with the overall banknote acceptor and dispenser 101 to complete various actions of the modified accumulator. Each of these actuators is easily available at the rear of the device and the count window 116 is clearly available at the back of the device to provide the count information to the operator. It can be appreciated the count window could also or alternatively display a dollar value.

FIG. 5 also shows the banknote acceptor and dispenser 101 for use with an unlocked plastic cassette 130. This plastic cassette is typically held in the device by a suitable spring latch arrangement in combination with locking lugs provided on the cassette receivable within locking ports of the frame 10. It is also possible for this device to operate in combination with a locked banknote cassette.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A banknote acceptor and dispenser comprising: a banknote validator;

a banknote accumulator and dispenser for temporarily receiving banknotes for dispensing as change for subsequent transactions; and a removable banknote cassette;

said banknote accumulator and dispenser including a count window providing information of the banknotes stored in said banknote accumulator and dispenser.

2. A banknote acceptor and dispenser as claimed in claim 1 wherein said banknote accumulator and dispenser includes at least two actuators that allow an operator to load said accumulator and dispenser with banknotes in an automated manner and unload said banknote accumulator and dispenser in an automated manner.

3. A banknote acceptor and dispenser as claimed in claim 1 wherein said count window provides an electronic display of the number of accumulated banknotes in said accumulator and dispenser.

4. A banknote acceptor and dispenser as claimed in claim 3 including at least two actuators that allow an operator to load said accumulator and dispenser with banknotes in an automated manner and unload said banknote accumulator and dispenser in an automated manner.

5. A banknote acceptor and dispenser as claimed in claim 3 said banknote accumulator and dispenser including a manual crank for manual adjustment of said banknote accumulator and dispenser.

6. A banknote acceptor and dispenser as claimed in claim 5 including a removable cover movable between a position covering said manual crank to an open position allowing access to said manual crank.

7. A banknote acceptor and dispenser as claimed in claim 1 wherein said banknote accumulator and dispenser has a back face with a series of actuators for loading and unloading of banknotes in said banknote accumulator and dispenser.

8. A banknote acceptor and dispenser as claimed in claim 7 wherein said banknote accumulator and dispenser include a manual crank for manual actuation thereof.

9. A banknote acceptor and dispenser as claimed in claim 1 wherein said banknote accumulator and dispenser includes an electrical set arrangement for setting of a banknote denomination to be accumulated and dispensed.

10. A banknote acceptor and dispenser as claimed in claim 9 wherein said electrical set arrangement includes at least two dip switches where each dip switch has at least two positions.

11. A banknote acceptor and dispenser as claimed in claim 10 wherein said electrical set arrangement is provided on an exterior rear surface of said accumulator and dispenser.

12. A banknote acceptor and dispenser as claimed in claim 1 including at least two actuators that allow an operator to load said accumulator and dispenser with banknotes in an automated manner and unload said banknote accumulator and dispenser in an automated manner.

13. A banknote acceptor and dispenser as claimed in claim 1 wherein said count window includes an electronic display, visible through said count window.

14. A banknote acceptor and dispenser as claimed in claim 13 wherein said electronic display displays the number of banknotes accumulated in said banknote accumulator and dispenser.

* * * * *